US011933142B2

(12) United States Patent
Kazanci et al.

(10) Patent No.: US 11,933,142 B2
(45) Date of Patent: Mar. 19, 2024

(54) TRACEABILITY OF CEMENTING PLUG USING SMART DART

(71) Applicant: Halliburton Energy Services, Inc., Houston, TX (US)

(72) Inventors: Mine Kazanci, Houston, TX (US); Randolph Dharamchan Depoo, Houston, TX (US); Stephen Allen Yeldell, Houston, TX (US); Luke Christopher Downey, Houston, TX (US); Jamaal Brickhouse, Houston, TX (US)

(73) Assignee: Halliburton Energy Services, Inc., Houston, TX (US)

( * ) Notice: Subject to any disclaimer, the term of this patent is extended or adjusted under 35 U.S.C. 154(b) by 37 days.

(21) Appl. No.: 17/330,808

(22) Filed: May 26, 2021

(65) Prior Publication Data

US 2022/0381116 A1 Dec. 1, 2022

(51) Int. Cl.

| | |
|---|---|
| ***E21B 37/10*** | (2006.01) |
| ***E21B 47/06*** | (2012.01) |
| ***E21B 47/14*** | (2006.01) |

(52) U.S. Cl.

CPC ..... *E21B 37/10* (2013.01); *E21B 47/06* (2013.01); *E21B 47/14* (2013.01)

(58) Field of Classification Search

CPC ..... E21B 37/10; E21B 37/02; E21B 47/06; E21B 33/12; E21B 33/13

See application file for complete search history.

(56) References Cited

U.S. PATENT DOCUMENTS 5,413,172 A 5/1995 Laurel
6,318,472 B1 11/2001 Rogers et al.
(Continued)

FOREIGN PATENT DOCUMENTS

EP 1055798 A2 11/2000

OTHER PUBLICATIONS

Foreign Communication from Related Application—International Search Report and Written Opinion of the International Searching Authority, International Application No. PCT/US2021/034245, dated Feb. 16, 2022, 10 pages.

*Primary Examiner* — Caroline N Butcher
(74) *Attorney, Agent, or Firm* — Conley Rose, P.C.; Rodney B. Carroll

(57) ABSTRACT

An instrumented wiper dart configurable at the wellsite comprising any combination of a sealing member, a sensor sub, an electronics package, and a communication system; wherein the sealing member is cylindrical in shape, releasably coupled to the wiper assembly, and configured to sealingly engage the inner surface of a workstring. The sensor sub is release releasably coupled to the wiper assembly, and includes one or more sensors to measure a property of the wellbore environment. The electronics package is releasably coupled to the wiper assembly, configured to receive one or more data sets from the sensor sub, and transmit one or more data sets to the communication sub. The communication sub is configured to transmit the one or more data sets; and wherein the instrumented wiper plug is displaced down the workstring in response to a volume of fluid pumped from surface.

20 Claims, 5 Drawing Sheets

(56) References Cited

U.S. PATENT DOCUMENTS

| | | | | |
|---|---|---|---|---|
| 6,318,478 | B1 * | 11/2001 | Kaneko | B25D 17/24 173/4 |
| 6,585,042 | B2 | 7/2003 | Summers | |
| 8,826,979 | B2 | 9/2014 | James et al. | |
| 2002/0157828 | A1 | 10/2002 | King et al. | |
| 2011/0277984 | A1 * | 11/2011 | Woie | E21B 37/00 166/66 |
| 2014/0196893 | A1 | 7/2014 | Vigneaux | |
| 2014/0251603 | A1 | 9/2014 | Raducanu et al. | |
| 2014/0367083 | A1 * | 12/2014 | McClinton | E21B 33/1292 166/192 |
| 2015/0101812 | A1 * | 4/2015 | Bansal | E21B 29/002 166/55 |
| 2017/0067304 | A1 | 3/2017 | Turley et al. | |
| 2020/0173252 | A1 | 6/2020 | Lende et al. | |
| 2020/0240258 | A1 * | 7/2020 | Stokely | E21B 47/005 |
| 2020/0392803 | A1 * | 12/2020 | Zhao | E21B 47/00 |

* cited by examiner

TRACEABILITY OF CEMENTING PLUG USING SMART DART

CROSS-REFERENCE TO RELATED APPLICATIONS

None.

STATEMENT REGARDING FEDERALLY SPONSORED RESEARCH OR DEVELOPMENT

Not applicable.

REFERENCE TO A MICROFICHE APPENDIX

Not applicable.

BACKGROUND

In the construction of oil and gas wells, a wellbore is drilled into one or more subterranean formations or zones containing oil and/or gas to be produced. In most instances, after the wellbore is drilled, the drill string is removed and a casing string is run into the wellbore. The annular space between the wellbore wall and a casing string, generally referred to as casing, can be filled with cement to isolate pressure within the wellbore from pressure within the formation. The process filling the annulus with cement can be referred to as "cementing" the wellbore. Cement can be pumped into the wellbore between two plugs. A lower plug can be inserted into the casing string and cement pumped into the casing. The volume of the cement forces the lower plug down the casing string. An upper plug can be inserted into the casing string after the desired amount of cement has been injected. The upper plug, the cement, and the lower plug can be forced downhole by injecting displacement fluid into the casing string. The cement exits the bottom of the casing to fill the annular space between the casing and the wellbore. Service personnel use pressure variations to determine when the lower plug and upper plug have reached the bottom of the liner. The failure of the upper plug to reach bottom can result in a deficient quality or quantity of the cement that may require a remedial operation to repair.

DETAILED DESCRIPTION OF THE INVENTION

Figure 1:
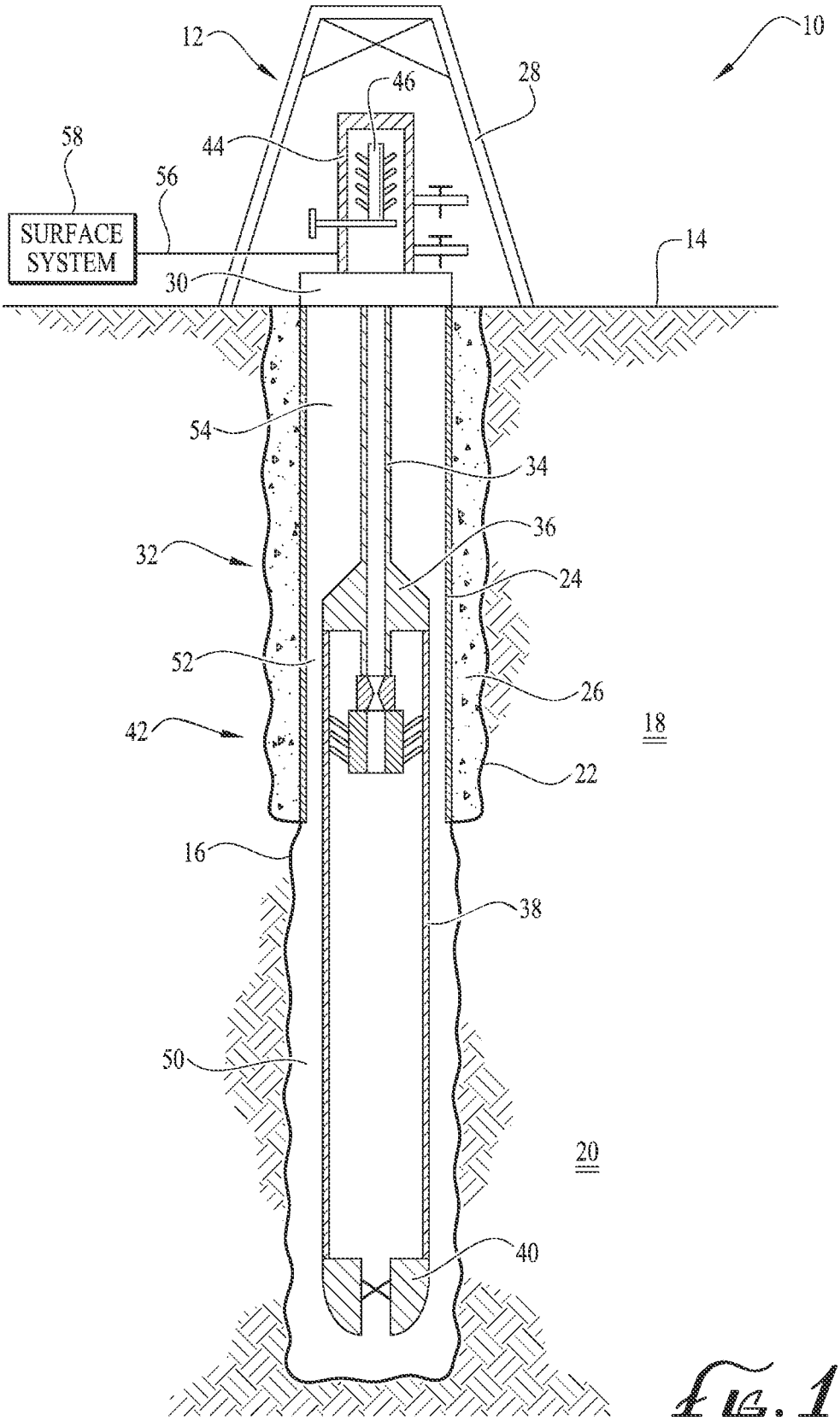
FIG. 1 shows a schematic view of an embodiment of the cementing operational environment.

It should be understood at the outset that although illustrative implementations of one or more embodiments are illustrated below, the disclosed systems and methods may be implemented using any number of techniques, whether currently known or not yet in existence. The disclosure should in no way be limited to the illustrative implementations, drawings, and techniques illustrated below, but may be modified within the scope of the appended claims along with their full scope of equivalents.

In some wells, it can be advantageous to run a second casing string, generally referred to as a liner, into a first casing string to extend the depth of the well. The liner has a smaller diameter to fit inside the inner diameter of the first casing string. After the wellbore below the first casing string has been drilled to a desired depth, a liner is lowered on a workstring to a desired depth. The liner string can include a liner hanger to anchor the liner at the desired depth. The liner string can be isolated with cement. The cementing operation can use a specialized one or two plug system that is preinstalled into the top of the liner and carried into the well below the workstring. The two plug system has an open bore to allow wellbore fluids to be pumped as the workstring, liner hanger, plug system, and liner is lowered into the well.

The cementing operation may begin by dropping a first plugging device to plug and release the lower cementing plug. The first plugging device can be released from surface into the workstring closely followed by a cement slurry. The first plugging device can release a lower cementing plug and the surface pumps can pump the cement slurry through the workstring to fill the liner and force the lower plug downhole. A second plugging device can be inserted into the workstring at surface at the end of the desired amount of cement has been pumped. A displacement fluid can be pumped into the well to force the second plugging device down the workstring. The second plugging device plugs the bore of the upper plug and releases the upper plug from the workstring. The combined wiper plug and upper plug can be forced down the liner by the displacement fluid being pumped from surface. Variations in pressure of the displacement fluid can be used to determine the location of the upper plug, the cement, and the lower plug. These variations in pressure can be small and may not always be detected or may be incorrectly interpreted. Knowing the position of the upper plug, and thereby the cement below it, can prevent damage to the well or other errors in the cementing process. For example, variations in the pressure of the displacement fluid within the lower plug is trapped at an undersized location in the casing string can be incorrectly interpreted to mean that lower plug has reached its destination at a float color or at the lower plug at the bottom of the liner string. Knowing the location of the upper cement lug can increase the integrity of the well. Well operators are often required by regulatory members to know the position of the top of the cement in the wellbore.

Problems with cementing can lead to a not enough cement being placed into the annulus between the casing and wellbore. Ending the pumping of displacement fluid tool early can leave the upper plug well above the lower plug and suspend a portion of the cement inside the casing. The excess cement left inside the casing can cause the annulus to not receive enough cement. Too little cement in the annulus can lead voids, incomplete coverage, a loss of pressure isolation, and corrosion of the casing string. Another cementing problem can be caused by over pressuring of the upper plug. Failure to recognize that the upper plug has reached the lower plug at the bottom of the liner can cause the pumps to over pressure and break the plug. The failure of the upper plug can lead to a loss of pressure integrity and the displacement fluid leaking to contaminate the cement in the annulus. The problems described with cementing, stopping the lower plug too soon and damaging the lower plug, can be attributed to not know where the upper and lower plugs are in the casing string.

One solution can use a cementing dart that communicates the location of the cementing dart to surface. In an embodiment, a cementing dart can include sensors, such as a collar tracker sensor, temperature sensor, pressure sensor, and chemical sensor, to measure a property of the wellbore. The cementing dart can measure the wellbore properties as the displacement fluid from the surface pumps forces it down the workstring. The measurements from the sensors on the cementing dart can be transmitted to surface via cable or via acoustic transmission. The operator or service company may have a need to measure more than one environmental property.

In an embodiment, a cement dart can be configurable at surface to measure one or more environmental properties. The cement dart can include one or more sensor modules that are configurable at the wellsite. A sensor module can include one or more sensors such as a magnetic sensor, a pressure sensor, and a temperature sensor. The sensor module can also measure one or more fluid properties such as water content, a fluid pH value, and density. One or more sensor modules can be configured with the cementing dart to measure one or more properties downhole. The configured cement wiper can then be pumped into the workstring with a displacement fluid. The cement wiper can plug and release the upper plug at the end of the workstring. The cement wiper and upper plug combination can be pumped down the casing string by the displacement fluid from the surface pumps. The cement wiper can measure environmental and fluid properties. The measurements from the environmental sensors can be transmitted to surface and correlated to a location in the workstring and liner string.

Turning now to FIG. 1, an embodiment of a cementing operating environment in which an instrumented wiper plug can be deployed is illustrated. The cementing operating environment 10 comprises a servicing rig 12 that extends over and around a wellbore 16 that penetrates a subterranean formation 18 for the purpose of recovering hydrocarbons. The wellbore 16 can be drilled into the subterranean formation 18 using any suitable drilling technique. While shown as extending vertically from the surface 14 in FIG. 1, the wellbore 16 can also be deviated, horizontal, and/or curved over at least some portions of the wellbore 16. For example, the wellbore 16, or a lateral wellbore drilled off of the wellbore 16, may deviate and remain within one of the production zones 20. The wellbore 16 can be cased, open hole, contain tubing, and can generally be made up of a hole in the ground having a variety of shapes and/or geometries as is known to those of skill in the art. In the illustrated embodiment, a primary wellbore 22 can be drilled into subterranean formation 18. A primary casing string 24 can be placed in the primary wellbore 22 and secured at least in part by cement 26.

The servicing rig 12 can be one of a drilling rig, a completion rig, a workover rig, or other structure and supports cementing operations in the wellbore 16. The servicing rig 12 can also comprise a derrick 28 with a rig floor 30 through which the toolstring 32 extends downward from the servicing rig 12 into the wellbore 16. In some cases, such as in an off-shore location, the servicing rig 12 can be supported by piers extending downwards to a seabed. Alternatively, the servicing rig 12 can be supported by columns sitting on hulls and/or pontoons that are ballasted below the water surface, which can be referred to as a semi-submersible platform or floating rig. In an off-shore location, a casing can extend from the servicing rig 12 to exclude sea water and contain drilling fluid returns. It is understood that other mechanical mechanisms, not shown, can control the run-in and withdrawal of the toolstring 32 in the wellbore 16, for example a draw works coupled to a hoisting apparatus, another servicing vehicle, a coiled tubing unit and/or other apparatus.

The toolstring 32 can include a workstring 34, a liner hanger 36, a liner string 38, a float shoe 40, and a cementing plug assembly 42. The workstring 34 can be any of a string of coiled tubing or jointed pipes, for example, drill pipe, work-over pipe, or production tubing. In some contexts, the toolstring 32 can be referred to as a workstring. The toolstring 32 can be lowered into the wellbore 16 to position the liner 38 to set or actuate a liner hanger 36 to anchor the liner string 38 at a predetermined depth. Although a liner hanger 36 is shown, it is understood that the liner hanger 36 could be a tubing hanger, a packer, a conventional liner hanger with slips, an expandable liner hanger, an expandable packer, or any other type of anchoring device to anchor or maintain the position of the liner string 38 relative to the primary casing string 24.

The toolstring 32 is lowered into the wellbore 16 by workstring 34. Rig pumps can circulate drilling fluids through the workstring 34, cementing plug assembly, liner string 38, and float shoe 40 to lubricate the wellbore 16 for passage of the liner string 38. When the toolstring 32 reaches the desired location, a ball or similar device can be released from a drop assembly 44 to pass through the workstring 34 to the liner hanger 36. The liner hanger 36 can be actuated through any combination of ball release, applied pressure, workstring rotation, or raising and lowering the workstring 34. Cement can be pumped down the workstring 34 to the cementing plug assembly 42. A lower plug can be released from below the liner hanger 36 by a drop bar, ball, or other means. The cement slurry pumped by surface pumps pushes the lower plug down the liner string 38. After a predetermined volume of cement has been pumped into the workstring 34, an instrumented dart 46 can be released from the drop assembly 44. The instrumented dart 46 can forced down the workstring 34 by the spacer fluid pumped from the surface pumps.

Figure 2A:
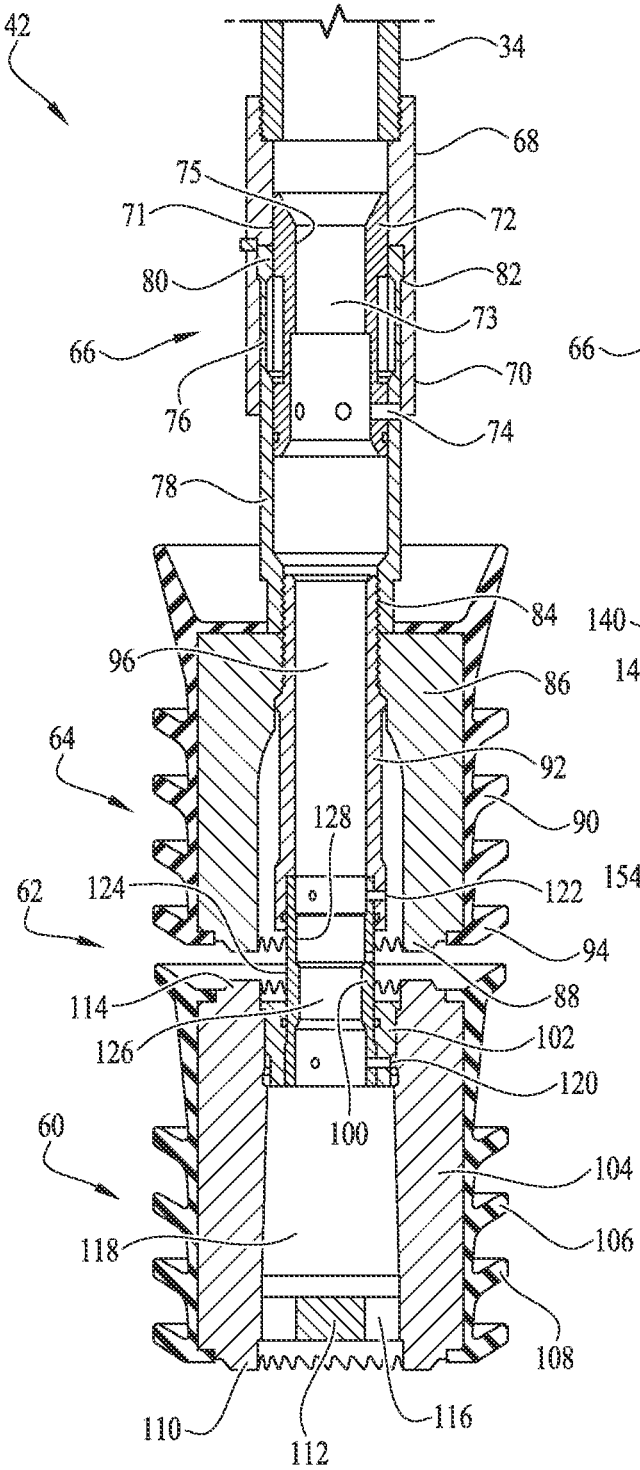
FIG. 2A shows a cross section of an embodiment of the cementing plug assembly.

Turning now to FIG. 2A, the cementing plug assembly 42 comprises a lower plug 60, a lower plug release 62, an upper plug 64, and an upper plug release 66. The upper plug release 66 can include an upper adapter 68, a collet retainer 70, a release sleeve 72. The upper adapter 68 can be attached to workstring 34, a drill pipe, or other string of pipe. The collet retainer 70 can be attached to the upper adapter 68. A plurality of collet finger 76 of a collet 78 can be disposed in collet retainer 70 such that head portions 80 of a plurality of collet fingers 76 engage shoulder 82 of collet retainer 70. A release sleeve 72 can include an outer surface 71, an inner bore 73 with an inner surface 75, and can be slidably disposed in collet 78. The outer surface 71 of the release sleeve 72 can retain the head portions 80 of collet finger 76 engaged with shoulder 82 in collet retainer 70. A shearing device 74, such as a shear pin or shear screw, can engage with collet 78 and release sleeve 72 to retain the releasing sleeve in a first position. The collet 78 can be attached to the upper plug 64 at threaded connection 84.

An upper plug 64, also referred to as a top plug, upper wiper plug, and top wiper plug, is a plug device with an inner bore 96 that fluids such as drilling fluid and cement can pass. The plug is generally a cylinder with a plurality of flexible fins or wipers on the outside to provide a seal with the inner surface of the casing and to wipe or scrape cement and other debris from the inner surface of the casing or liner string. The body of the upper plug 64 is generally made from a material can be drilled or milled for removal such as a combination of plastics and elastomers.

The upper plug 64 comprises a body or insert 86, a jacket 90, and a connector 92. The insert 86 can be threaded to threadingly connect with the connector 92. The insert 86 can be manufactured from a drillable material, for example plastics, phenolics, composite materials, aluminum alloy, magnesium alloy, brass alloy, or glass. A plurality of integrally formed teeth 88 can be located on the lower end of insert 86. The insert 86 can be substantially surrounded by a jacket 90 bonded to the insert 86 and can be made of an elastomeric material. Jacket 90 includes a plurality of wipers 94 adapted for sealingly engaging the inside surface of a casing string 24 or a liner string 38.

A lower plug 60, also referred to as a bottom plug, lower wiper plug, and bottom wiper plug, is a plug device with an inner bore 118 that fluids such as drilling fluid and cement can pass. The plug is generally a cylinder with a plurality of flexible fins or wipers on the outside to provide a seal with the inner surface of the casing and to wipe or scrape cement and other debris from the inner surface of the casing or liner string. The body of the lower plug 60 is generally made from a material can be drilled or milled for removal such as a combination of plastics and elastomers.

The lower plug 60 comprises a body or insert 104, a jacket 106, a bushing 102, a release sleeve 100, and a bottom plate 112. The bushing 102 can be threadingly connected to the insert 104. The insert 104 can be manufactured from a drillable material, for example plastics, phenolics, composite materials, aluminum alloy, magnesium alloy, brass alloy, or glass. A first set of a plurality of integrally formed teeth 114 can be located at the upper end of insert 104. A second set of a plurality of integrally formed teeth 110 can be located on the lower end of insert 104. The insert 104 can be substantially surrounded by a jacket 106 bonded to the insert 104 and can be made of an elastomeric material. Jacket 106 includes a plurality of wipers 108 adapted for sealingly engaging the inside surface of a casing string 24 or a liner string 38. The bottom plate 112 can include a plurality of ports 116. The release sleeve 100 can be releasably connected to the bushing 102 by a shear device 120, for example a shear pin, a shear screw, or a collet assembly. In an aspect, the insert 104 can have a flat surface in place of the integrally formed teeth 114 located at the upper end of insert 104 and a flat surface in place of the integrally formed teeth 110 located at the lower end of insert 104.

The lower plug release 62 can releasably connect the lower plug 60 to the upper plug 64. The lower plug release 62 can comprise the release sleeve 100 and a shear device 122. The release sleeve 100 can include an outer surface 124, and an inner bore 126 with an inner surface 128. The release sleeve 100 can be releasably connected to the connector 92 of the upper plug 64 by a shear device 122, for example a shear pin or shear screw. The shear device 120 connected to the bushing 102 can break at a higher value, the same value, or a lower value than the shear device 122 connected to the connector 92.

Figure 2B:
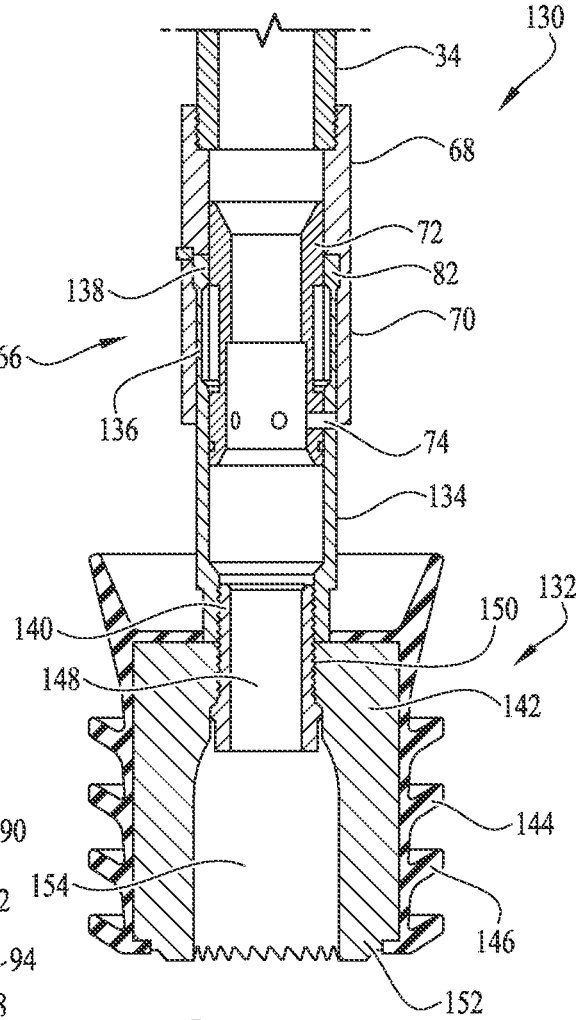
FIG. 2B shows a cross section of another embodiment of the cementing plug assembly.

Some plug systems can use a single plug to cement a liner in place of a two plug system. Turning now to FIG. 2B, in an embodiment, a cementing plug assembly 130 comprises an upper plug release 66, and a single plug 132, also called a cementing plug. The upper plug release 66 can be same assembly as previously described in FIG. 2A. The upper plug release 66 can include an upper adapter 68, a collet retainer 70, a release sleeve 72. The upper adapter 68 can be attached to workstring 34, a drill pipe, or other string of pipe. The collet retainer 70 can be attached to the upper adapter 68. A plurality of collet finger 136 of a collet 134 can be disposed in collet retainer 70 such that head portions 138 of a plurality of collet fingers 136 engage shoulder 82 of collet retainer 70. A release sleeve 72 can be slidably disposed in collet 134. The release sleeve 72 can retain the head portions 138 of collet finger 136 engaged with shoulder 82 in collet retainer 70. A shearing device 74, such as a shear pin or shear screw, can engage with collet 134 and release sleeve 72 to retain the release sleeve 72 in a first position. The collet 134 can be attached to the single plug 132 at threaded connection 140.

A single plug 132, also referred to as a top plug, upper wiper plug, and top wiper plug, is a plug device with an inner bore 154 that fluids such as drilling fluid and cement slurry can pass. The plug is generally a cylinder with a plurality of flexible fins or wipers on the outside to provide a seal with the inner surface of the casing and to wipe or scrape cement and other debris from the inner surface of the casing or liner string. The body of the upper plug 64 is generally made from a material can be drilled or milled for removal such as a combination of plastics and elastomers.

The single plug 132 comprises a body or insert 142, a jacket 144, and an end sub 150. The insert 142 includes an inner bore 154 and can connect with the end sub 150. The insert 142 can be manufactured from a drillable material, for example plastics, phenolics, composite materials, aluminum alloy, magnesium alloy, brass alloy, or glass. A plurality of integrally formed teeth 152 can be located on the lower end of insert 142. The insert 142 can be substantially surrounded by a jacket 144 bonded to the insert 142 and can be made of an elastomeric material. Jacket 144 can include a plurality of wipers 146 adapted for sealingly engaging the inside surface of a casing string 24 or a liner string 38. The end sub 150 can include an inner bore 148 and connect with the collet 134 at connection 140. In an aspect, the insert 142 can have a flat surface in place of the integrally formed teeth 152 located at the lower end of insert 142.

Figure 3:
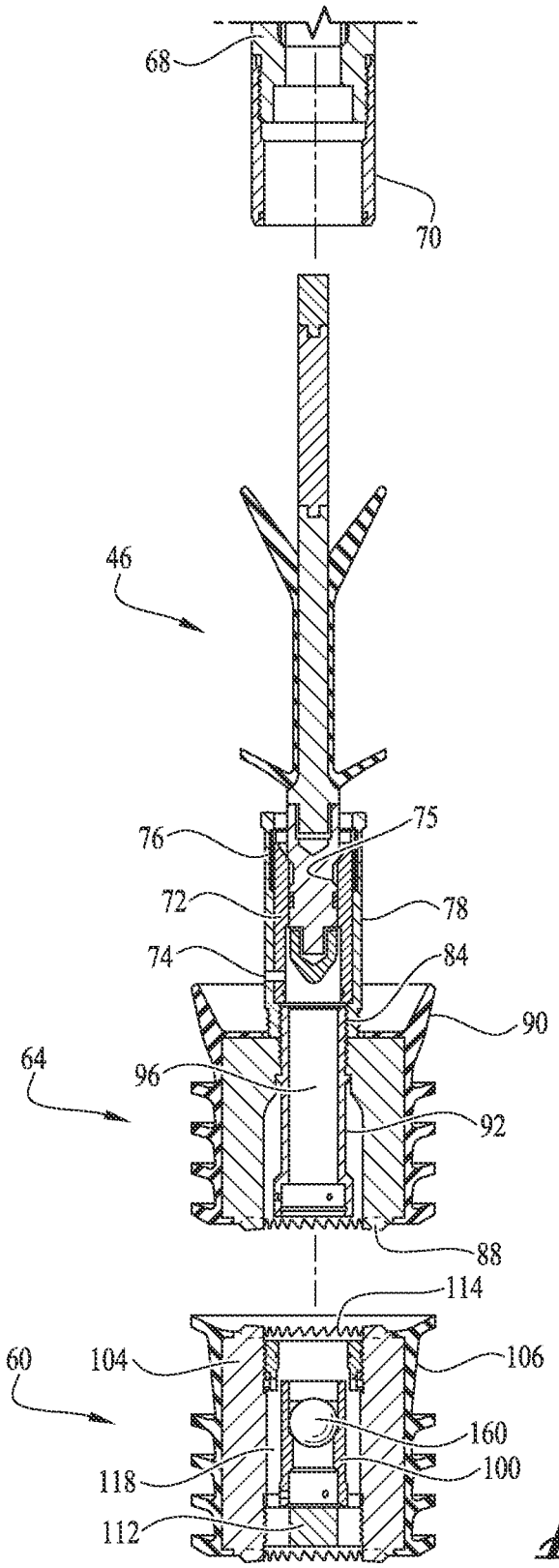
FIG. 3 shows a section view of the instrumented dart engaging the top section of the upper plug according to an embodiment of the cementing plug assembly.

The operation of cementing plug assembly 42 may be described initially with reference to FIGS. 1 and 3. As shown in FIG. 1, liner 38, cementing plug assembly 42, and liner hanger 36 may be lowered to the desired depth on workstring 34. The liner hanger 36 can comprise additional tools such as setting tool and actuation system not shown. Once liner 35 has reached the desired depth, the liner hanger 36 can be actuated by rotation, ball drop, pressure applied down the tubing, or interventionless means. The actuation of the liner hanger 36 engages, e.g., anchors, the liner 38 to the casing 24. The surface pumps can circulate drilling fluid down the workstring 34, through the liner hanger 36, through the cementing plug assembly 42, through the liner string 38, and out of the float shoe 40. The drill fluid will return to surface by flowing up the lower annulus 50, between the wellbore 16 and the liner 38, the middle annulus 52, between the liner 38 and the casing 24, and the upper annulus 54, between the casing 24 and the workstring 34.

Cementing operations begin with the pumping of a spacer fluid to flush drilling fluids out of the workstring 34. The cement slurry can be pumped into the workstring 34 after a predetermined volume of spacer fluid is pumped. Turning now to FIG. 2A, a plugging device 160, e.g., a release ball, can be released from the drop assembly 44 at surface 14 during the pumping of the spacer fluid or the cement slurry. The release ball 160 can be pumped through the workstring 34 until it engages release sleeve 100. Pressure is increased until the shear device 122 shear releasing the lower plug 60. The release ball 160 can form a seal within the release sleeve 100 that prevents fluid, e.g., spacer fluid and cement, from passing through the release sleeve 100. The continued pumping of the spacer fluid and/or cement slurry pushes the lower plug 60 down the liner string 38. When the lower plug 60 reaches the float shoe 40, the pressure can be increased at surface to shear the shear device 120 between the release sleeve 100 and the bushing 102 to release the release sleeve 100. Turning now to FIG. 3, the release ball 160 and release sleeve 100 contact the bottom plate 112 as the cement slurry above the lower plug 60 flows past the release sleeve 100, through the plurality of port 116 in the bottom plate 112, and through the float shoe 40 (shown in FIG. 1).

The service personnel can configure an instrumented wiper dart for deployment. The instrumented wiper dart can be configured to measure and transmit data from one or more sensors as will be described further hereinafter. The instrumented dart 46 can be configured to transmit data while at surface, when signaled from surface, or when sensors detect a change in conditions, e.g., pressure greater than atmospheric pressure. The instrumented dart 46 can be loaded into the drop assembly 44. The instrument dart 46 can begin transmitting data within the drop assembly 44. After a predetermined amount of cement slurry has been pumped, the instrumented dart 46 can be released from the drop assembly 44 into the workstring 34. The instrumented dart 46 can begin transmitting data immediately, after a time delay, or when signaled from surface. A displacement fluid can be pumped after the instrumented dart 46 by the surface pumps. The instrumented dart 46 can transmit data back to surface via a communication method as will be described further hereinafter.

The instrumented dart 46 travels down the workstring 34 to the cementing plug assembly 42 that comprises the upper plug 64 and the upper plug release 66. The instrumented dart 46 sealingly engages the inner surface 75 of the release sleeve 72 and blocks the inner bore 73 of the release sleeve 72. Pressure applied by the surface pumps shears the shear device 74 and the release sleeve 72 moves from a first position shown in FIG. 2A to a second position shown in FIG. 3. The second position of the release sleeve 72 moves the outer surface 71 from engaging the head portions 80 and releases the collet 78 of the upper plug 64 from the upper plug release 66.

The instrument dart 46 can transmit data while coupled to the upper plug 64 via the release sleeve 72 as the upper plug 64 is forced down the liner 38 by the displacement fluid.

Figure 4A:
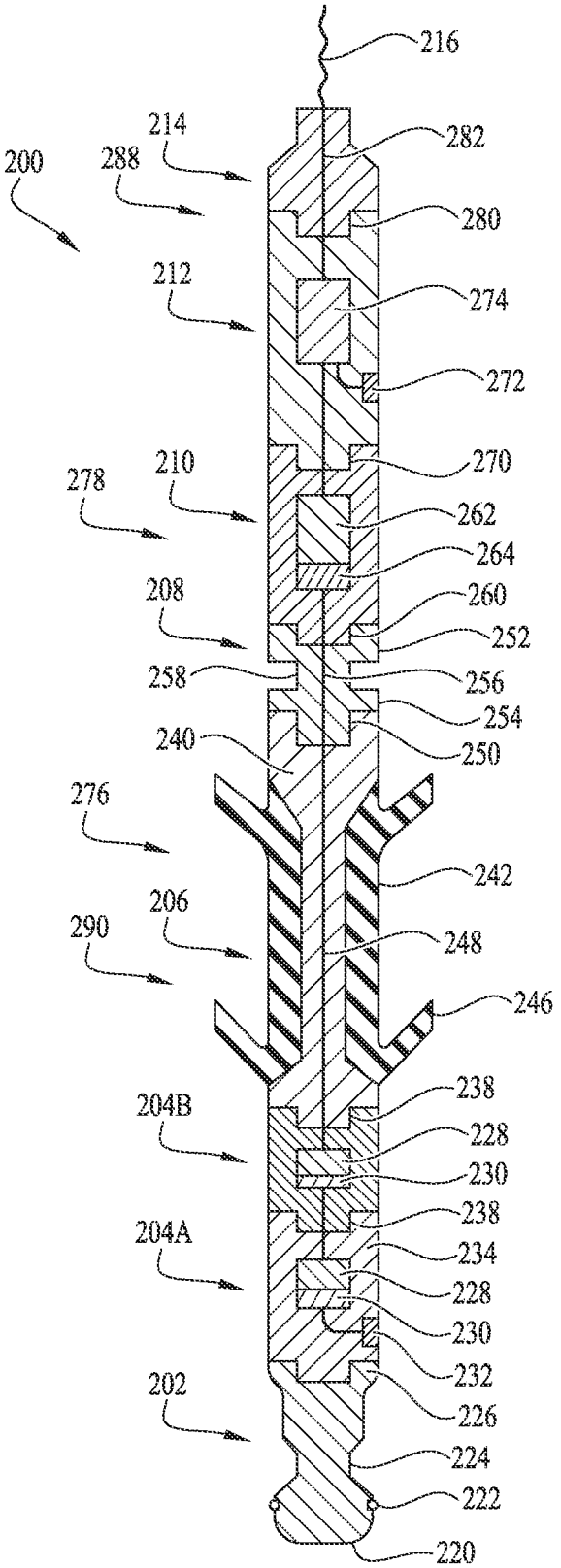
FIG. 4A shows a cross section view an embodiment of the instrumented dart.

Service personnel at surface can release and track the upper plug with an instrumented wiper dart. Turning now to FIG. 4A, an instrumented wiper dart 200 is illustrated. An instrumented wiper dart 200 can comprise a plug nose 202, an instrument sub 204, a sealing member 290, a release sub 208, an electronics sub 210, a fluid sub 212, and a communication system 288. The plug nose 202 can include a profile surface 220, an end seal 222, and a locking profile 224. The profile surface 220 can guide the plug nose 202 into a plug seat. The end seal 222 can sealingly engage the plug seat to provide a fluid seal between the plug nose 202 and the plug seat. The locking profile 224 can provide a location for a locking device to engage or secure the plug nose 202 to a second device. The plug nose 202 can be located on the downhole end of the wiper dart and coupled to the instrument sub 204 by connection 226.

The instrument sub 204 comprises one or more environmental sensors 228. The environmental sensors 228 can measure a downhole environmental property and have one or more internal sensors 230, one or more external sensors 232, one or more fluid sensors 274, or any combination thereof. The internal sensor 230 can provide measurements of a downhole environmental property at a predetermined periodic rate of the environment inside the instrument chamber 234. The external sensor 232 can provide measurements of a downhole environmental property at a predetermined periodic rate of the wellbore environment exterior of the instrument sub 204. The environmental sensor 228 can be one or more of a temperature sensor, a pressure transducer, an accelerometer, a magnetic sensor, or an acoustic sensor. The environmental sensor 228 can include pressure and temperature sensors to measure the pressure and temperature of the wellbore environment, the pressure and temperature of the instrument chamber 234 of the instrument sub 204, or any combination thereof. The environmental sensor 228 can include a motion sensor that can be one or more accelerometers. The measurements of the accelerometers can indicate motion of the wiper dart 200. The environmental sensor 228 can include a magnetic sensor commonly referred to as a collar locator. The magnetic sensor measures the magnetic response of the casing, liner, or workstring. The collars that connect the casing, liner, drill pipe, or tubing have a different magnetic signature than the tubing bodies. The collar locator measures and counts the collars. The number of collars counted can be correlated to a tubing tally to indicate the location of the instrument sub 204 and the wiper dart 200 within the wellbore. The environmental sensor 228 can include an acoustic sensor (e.g., microphone, piezoelectric transducer) that measures the acoustic waves or sound levels using the internal sensor 230 within the instrument chamber 234 of the instrument sub 204 or the acoustic waves using the external sensor 232 of the instrument sub 204. The environmental sensor 228 can be a nuclear sensor that measures gamma ray or neutron count rates. The instrument sub 204 can be mechanically and electrically coupled to the dart body 206 at connection 238.

In an embodiment, the instrument sub 204A can comprise a combination of one or more external sensors 232, one or more external fluid sensors 272, and one or more internal sensors 230. The instrument sub 204A can transmit the measurements to the electronics sub 210 via the electrical coupling.

In an embodiment, the instrument sub 204B can comprise one or more internal sensors 230. The instrument sub 204B can transmit the measurements to the electronics sub 210 via the electrical coupling.

The sealing member 290 can be a dart body 206. The dart body 206 can be a generally cylindrical shape and comprises a dart insert 240, a dart jacket 242, and a conductor 248. The dart insert 240 can be manufactured from a drillable material, for example plastics, phenolics, composite materials, aluminum alloy, magnesium alloy, brass alloy, or glass. The dart insert 240 can be substantially surrounded by a dart jacket 242 bonded to the dart insert 240 and can be made of an elastomeric material. Dart jacket 242 includes a plurality of fins 246 adapted for sealingly engaging the inside surface of a workstring 34. A conductor 248 can transfer voltage, power, and electronic signals through the dart body 206. The dart body 206 can be mechanically and electrically coupled to the release sub 208 by connection 250.

Although the dart jacket 242 is shown installed on dart insert 240 in FIG. 4A, it is understood that the dart jacket 242 can be installed around instrument sub 204, electronics sub 210, fluids subs 212, communication system 288 and these subs can be used as sealing member 290.

Although dart jacket 242 is shown installed on dart insert 240 in FIG. 4A, it is understood that dart jacket 242 can be bonded to or otherwise installed about the components comprising the instrumented wiper dart 200 including the one or more instrument subs 204, the electronics sub 210, the one or more fluids subs 212, and the communication system 288. The sealing member 290 can be the one or more instrument subs 204, the electronics sub 210, the one or more fluids subs 212, the communication system 288 with the dart jacket 242 surrounding and bonded onto.

The release sub 208 can disconnect or detach an upper section from a lower section of the wiper dart 200. The upper section 278 can include the attachable components above the release sub 208. For example, in FIG. 4A, the upper section 278 includes the communication cable 216, the cable head 214, the fluid sub 212, and the electronics sub 210. The lower section 276, in the example of FIG. 4A, includes, the dart body 206, the plug nose 202, instrument sub 204A, and instrument sub 204B. The release sub 208 can comprise an upper part 252, a conductor 256, a lower part 254, and a separation point 258. The separation point 258 connects the upper part 252 to the lower part 254 and passes the conductor 256 through. The separation point 258 can be a reduced cross-sectional area of the release sub 208 that will separate upon activation, e.g., break or fail at a predetermined value when tension is applied. The failure of the separation point 258 will split the release sub 208 into two separate parts, e.g., the upper part 252 and the lower part 254. The release of the separation point 258 will split the wiper dart 200 into the upper section 278 connected to the upper part 252 and the lower section 276 connected to the lower part 254. The release sub 208 can be mechanically and electrically coupled to the electronics sub 210 by connection 260.

In an aspect, the separation point 258 of the release sub 208 comprise a shear device, for example shear screws or shear pins. The separation point 258 can release the upper part 252 from the lower part 254 when the shear device breaks at a predetermined value. In an aspect, the separation point 258 of the release sub 208 can comprise a pyrotechnic fastener, e.g., a pyro-bolt. The separation point 258 can release the upper part 252 from the lower part 254 when the pyrotechnic fastener is electronically activated to break by igniting a pyrotechnic material. In an aspect, the separation point 258 of the release sub 208 can comprise a spring loaded mechanism. In an aspect, the separation point 258 of the release sub 208 can comprise a spring loaded mechanism with fluid damper timer. The separation point 258 can release the upper part 252 from the lower part 254 when tension is applied through the separation point 258 for a predetermined time period.

The electronics sub 210 can comprise a printed circuit board, a transceiver, a microprocessor, non-transitory memory 264, and an application 262 executing in memory. The non-transitory memory can include instructions stored therein defining the operation of the wiper dart 200. The electronics sub 210 can include a power source such as one or more batteries or ultracapacitors. The electronics sub 210 can be mechanically and electrically coupled to the fluid sub 212 by connection 270.

In an embodiment, the electronics sub 210 and the instrument sub 204 can be combined so that the combined instrument sub 204 comprises a printed circuit board, a transceiver, a microprocessor, non-transitory memory 264, and an application 262 executing in memory. The non-transitory memory can include instructions stored therein defining the operation of the wiper dart 200. The combined instrument sub 204 can include a power source such as one or more batteries or ultracapacitors. As previously described, the combined instrument sub 204 can comprise one or more environmental sensors 228. The environmental sensors 228 can measure a downhole environmental property and have one or more internal sensors 230, one or more external sensors 232, one or more fluid sensors 274, or any combination thereof. The combined instrument sub 204 can measure environmental data from the environmental sensors 228, store measured data within the non-transitory memory 264, and transmit via the transceiver.

The fluid sub 212 comprises one or more fluid sensors 274. The fluid sensors 274 can measure a fluid property and have one or more external fluid sensors 272. The external fluid sensor 272 can provide measurements at a predetermined periodic rate of the wellbore fluids exterior of the fluid sub 212. The fluid sensor 274 comprise one or more of a water cut sensor, a fluid pH value sensor, or a density sensor. In an aspect, the fluid sub 212 can include one or more environmental sensors 228 such as an accelerometer, a magnetic sensor, an acoustic sensor, pressure sensor, and temperature sensors. The fluid sub 212 can be mechanically and electrically coupled to the cable head 214 at connection 280.

The communication system 288 can comprise a cable head 214 and a communication cable 216. The cable head 214 can electrically connect the one or more electrical conductors 282 to another component of the wiper dart 200 as will be described herein. The cable head 214 can include a fishing profile and an electronic connection to a communication cable 216. The communication cable 216 can comprise a shielded electrical conductor, fiber optic cable, or a combination of both. The electrical conductor can transfer voltage, power, and electronic communication to the wiper dart 200. The fiber optic cable can transfer communication in the form of optical wavelengths to the wiper dart 200.

Figure 4B:
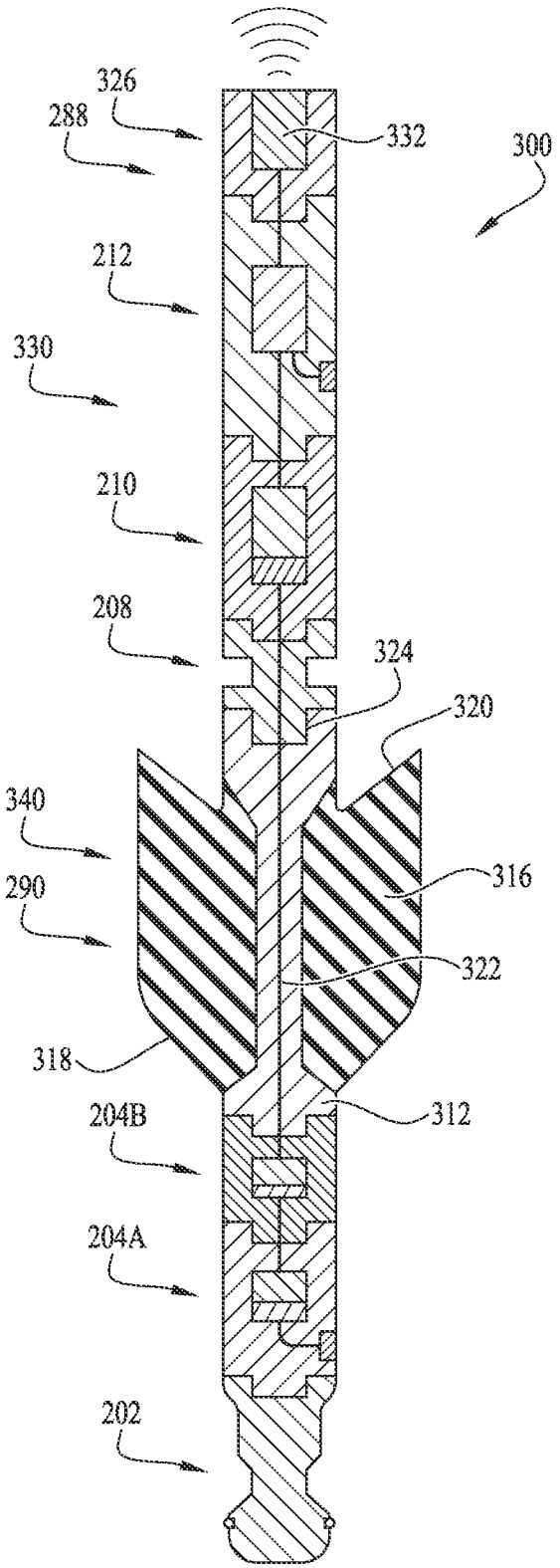
FIG. 4B shows a cross section view another embodiment of the instrumented dart.

Turning now to FIG. 4B, in an embodiment, an instrumented foam dart 300 is illustrated. An instrumented foam dart 300 can comprise a sealing member 290, a communication sub 326, and any number of components previously described in FIG. 4A, such as a plug nose 202, an instrument sub 204A, an instrument sub 204B, a release sub 208, an electronics sub 210, and, a fluid sub 212, a cable head 214, and a communication cable 216. The communication sub 326, the fluid sub 212, and the electronics sub 210 can be referred to as the electronics package 330.

The sealing member 290 can be a foam dart body 310. The foam dart body 310 can be a generally cylindrical shape comprise a foam body insert 312 and a conductor 322. The foam body insert 312 can be manufactured from a drillable material, for example plastics, phenolics, composite materials, aluminum alloy, magnesium alloy, brass alloy, or glass. The foam body insert 312 can be substantially surrounded by a foam body 316 bonded to the foam body insert 312. The foam body 316 can be constructed from any foamable material such as an elastomer including but not limited to open-cell foams comprising natural rubber, nitrile rubber, styrene butadiene rubber, polyurethane, or the like. Any open-cell foam having a sufficient density, firmness, and resilience may be suitable for the desired application. One of ordinary skill in the art with the benefit of this disclosure will be able to determine the appropriate construction material for foam body 316 given the compression and strength requirements of a given application. In certain exemplary embodiments of the present invention, foam body 316 comprises an open-cell, low-density foam. Foam body 316 generally should be sized to properly engage the inner wall of the largest diameter through which the dart will pass; in certain exemplary embodiments of the present invention, foam body 316 wipes clean the inner wall of the workstring 34, e.g., drill pipe, as the dart travels the length of the workstring 34, which length generally may extend the entire length of the well bore. Foam body 316 should also readily compress to pass through relatively small diameter restrictions without requiring excessive differential pressure to push the dart to the desired location. The foam body 316 can comprise a tapered leading edge 318 and one or more ribs or fins 320. The foam body insert 312 can comprise a conductor 322. The foam dart body can be mechanically and electrically connected to the release sub 208 by connection 324.

Although foam body 316 is shown installed on foam body insert 312 in FIG. 4B, it is understood that foam body 316 can be bonded to or otherwise installed about the components comprising the instrumented foam dart 300 including the one or more instrument subs 204, the electronics sub 210, the one or more fluids subs 212, the communication system 288. The sealing member 290 can be the one or more instrument subs 204, the electronics sub 210, the one or more fluids subs 212, the communication system 288 with the foam body 316 surrounding and bonded onto.

The communication system 288 can comprise a communication sub 326. The communication sub 326 can transmit acoustic signals up the wellbore through a column of fluid. The communication sub 326 can include a battery, electronics, and a signal generator 332. The electronics in the communication sub 326 can be disposed to generate and transmit an acoustic signal with a suitable acoustic signal generator, for example, one or more piezoelectric elements. The acoustic signal can travel up the column of fluid in the wellbore for receipt by an acoustic signal receiver, e.g., a microphone. The electronics in the communications sub 326 may include one or more batteries in addition to or in place of the one or more batteries in the electronics sub 210. In an aspect, the signal generator 332 can be a mud pulse generator. The electronics in the communications sub 326 can be disposed to generate and transmit mud pulses or dynamic changes the pressure of the fluid column.

Two types of wiper darts are shown in FIG. 4A and FIG. 4B. Wiper dart 200, in FIG. 4A, includes a dart body 206 with the dart jacket 242 made from elastomeric materials. Foam dart 300, in FIG. 4B, includes the foam body 316 manufactured from a foam material. Wiper dart 200 and foam dart 300 can be configured with any combination of sensors and communication method as disclosed herein.

Each component of the instrumented dart 46, e.g., wiper dart 200 and foam dart 300, can be interchangeably connected by mechanically and electrically coupling the components together. The instrument subs 204, the sealing members 290, the release sub 208, the electronics sub 210, the fluid sub 212, and the communication systems 288 have the same connection and can be interchangeably connected. Wiper assembly 292 can be defined as any combination of the instrument sub 204, the electronics sub 210, and the communication system 288. Additional components can be added to the wiper assembly 292 including the sealing member 290, the release sub 208, and the fluid sub 212. In this context, for example, an electronics sub 210 can releasably couple to the wiper assembly 292 and thus, to any component of the instrumented dart 46.

For example, wiper dart 200 can be initially configured with a plug nose 202, an electronics sub 210, and a cable head 214. One or more instrument sub 204 can be added to the wiper dart 200 configuration. For example, one or more of an instrument sub 204B with only an internal sensor 230 can be included. For example, one or more of instrument sub 204A with an external sensor 232 can be included. For example, one or more of the fluid sub 212 can be included. A release sub 208 can be included. The wiper dart 200 is shown with the cable head 214 and communication cable 216 for communication. It is understood that the wiper dart 200 can be configured with the communication sub 326 for communication. Although the release sub 208 is shown coupled above the dart body 206, it is understood that the disconnect sub can be placed anywhere within the configuration. Although the fluid sub 212 is shown above the dart body 206, it is understood that the one or more fluid sub 212 can be placed below the dart body 206 or anywhere within the configuration. Although the instrument sub 204 is shown below the dart body 206, it is understood that the instrument sub 204 can be placed above the dart body 206 or anywhere within the configuration.

The foam dart 300, shown in FIG. 4B, can be initially configured with a plug nose 202, an electronics sub 210, and a communication sub 326. One or more instrument sub 204 can be added to the foam dart 300 configuration. For example, one or more of the instrument sub 204B with only an internal sensor 230 can be included. For example, one or more of instrument sub 204A with an external sensor 232 can be included. For example, one or more of the fluid sub 212 can be included. A release sub 208 can be included. The foam dart 300 is shown with the communication sub 326 for communication. It is understood that the foam dart 300 can be configured with the cable head 214 and communication cable 216 for communication. Although the release sub 208 is shown coupled above the foam sub 340, it is understood that the release sub 208 can be placed anywhere within the configuration. Although the fluid sub 212 is shown above the foam sub 340, it is understood that the one or more fluid sub 212 can be placed below the foam sub 340 or anywhere within the configuration. Although the instrument sub 204 is shown below the foam sub 340, it is understood that the instrument sub 204 can be placed above the foam sub 340 or anywhere within the configuration.

In an embodiment, the instrumented dart 46 can be transported to the wellsite in an unassembled state. The instrumented dart 46 can comprise of a plurality of individual parts, such as a plug nose 202, one or more instrument sub 204, a sealing member 290, a release sub 208, an electronics sub 210, a fluid sub 212, and a communication system 288 in a non-assembled or unassembled state. The instrumented dart 46 in the unassembled state can be transported to the wellsite. The wellsite, also called a job site, can be the location of a pumping operation. One or more environmental sensors 228 in one or more instrument subs 204 can be configured to measure the one or more downhole environmental properties selected for measurement. The selection of the downhole environmental properties can be based on customer requirements, job requirements, service company selection, or combination thereof. The communication system 288 can be selected based on customer requirements, job requirements, service company selection, or a combination thereof. The electronics sub 210 may be configured to measure one or more data sets via the one or more instrument subs 204 and to transmit the data via the communication system 288 before the instrumented dart 46 is assembled. The electronics sub 210 may be coupled to the one or more instrument subs 204 or the communication system 288 and configured to measure and transmit data. The electronics sub 210 may be coupled to the one or more instrument subs 204 and the communication system 288 to be configured to measure and transmit data. The instrumented dart 46 can be assembled from the plurality of individual parts, at the wellsite, before the electronics sub 210 is configured to measure and transmit data.

In an embodiment, the instrumented dart 46 can be transported in a partially assembled state to the wellsite. The instrumented dart 46 can comprise of a plurality of individual parts, as previously described. Before transporting the instrumented dart 46 to the wellsite, one or more portions may be assembled. For example, one or more environmental sensors 228 in one or more instrument subs 204 can be configured to measure the one or more downhole environmental properties. As previously described, the communication system 288 can be selected. The instrumented dart 46 in a partially assembled state can comprise one or more instrument subs 204, the electronics sub 210, and the communication system 288. The electronics sub 210 may be coupled to the one or more instrument subs 204 or the communication system 288 and configured to measure and transmit data. The electronics sub 210 may be coupled to the one or more instrument subs 204 and the communication system 288 to be configured to measure and transmit data. The instrumented dart 46 in a partially assembled state can be transported to the wellsite. The instrumented dart 46 can be assembled by adding a plurality of individual parts, at the wellsite, to the partially assembled state. In an aspect, the electronics sub 210 can be configured to measure and transmit data after the instrumented dart 46 is fully assembled.

In an embodiment, the instrumented dart 46 in the fully assembled state is transported to the wellsite. The instrumented dart 46 can comprise of a plurality of individual parts, as previously described. The instrumented dart 46 may be fully assembled before transporting to the wellsite. For example, one or more environmental sensors 228 in one or more instrument subs 204 can be configured to measure the one or more downhole environmental properties. As previously described, the communication system 288 can be selected. The electronics sub 210 may be coupled to the one or more instrument subs 204 or the communication system 288 and configured to measure and transmit data. The electronics sub 210 may be coupled to the one or more instrument subs 204 and the communication system 288 to be configured to measure and transmit data. The instrumented dart 46 can be fully assembled, after the electronics sub 210 is configured, by adding a plurality of individual parts to the partially assembled state. In an aspect, the electronics sub 210 can be configured to measure and transmit data after the instrumented dart 46 is fully assembled.

The instrumented dart 46, for example a wiper dart 200 or a foam dart 300, can be configured to measure, store, and transmit data to the surface. The analysis of the data received at surface may indicate one or more problems encountered during a pumping operation. A method of configuring an instrumented dart comprising, selecting one or more downhole environmental properties to measure, configuring one or more environmental sensors 228 in an instrument sub 204 to measure the one or more downhole environmental properties. The one or more environmental sensors 228 of the instrument sub 204 can comprise i) an internal sensor, ii) an external sensor, iii) a fluid property sensor, or iv) combinations thereof. The 16. The one or more environmental sensors 228 are selected from a group consisting of a magnetic sensor, a pressure sensor, a temperature sensor, a motion sensor, an acoustic sensor, a pH value sensor, a water ratio sensor, a nuclear sensor, and combinations thereof.

The method of configuring an instrumented dart can further comprise selecting a communication system 288. The communication system 288 can comprise i) a cable head 214 and a communication cable 216, ii) an acoustic signal generator 332, or iii) combinations thereof.

The method of configuring an instrumented dart can further comprise assembling a wiper assembly 292, wherein the wiper assembly 292 comprises the instrument sub 204, an electronics sub 210, and the communication system 288.

The method of configuring an instrumented dart can further comprise, selecting a sealing member 290, wherein the sealing member 290 is releasably coupled to the wiper assembly 292, and wherein the sealing member 290 is i) a dart jacket 242 with a plurality of fins 246, ii) a foam body 316, or iii) combinations thereof.

The method of configuring an instrumented dart can further comprise, configuring the electronics sub 210 to measure one or more data sets via the instrument sub 204 and transmit the one or more data sets via the communication system 288. The electronics sub 210 can be i) configured prior to assembling the wiper assembly 292, ii) configured while assembling the wiper assembly 292, or iii) configured after assembling the wiper assembly 292.

The method of configuring an instrumented dart can further comprise, transporting the wiper assembly 292 to a wellsite i) in an unassembled state, ii) in a partially assembled state, or iii) in a fully assembled state.

Figure 5:
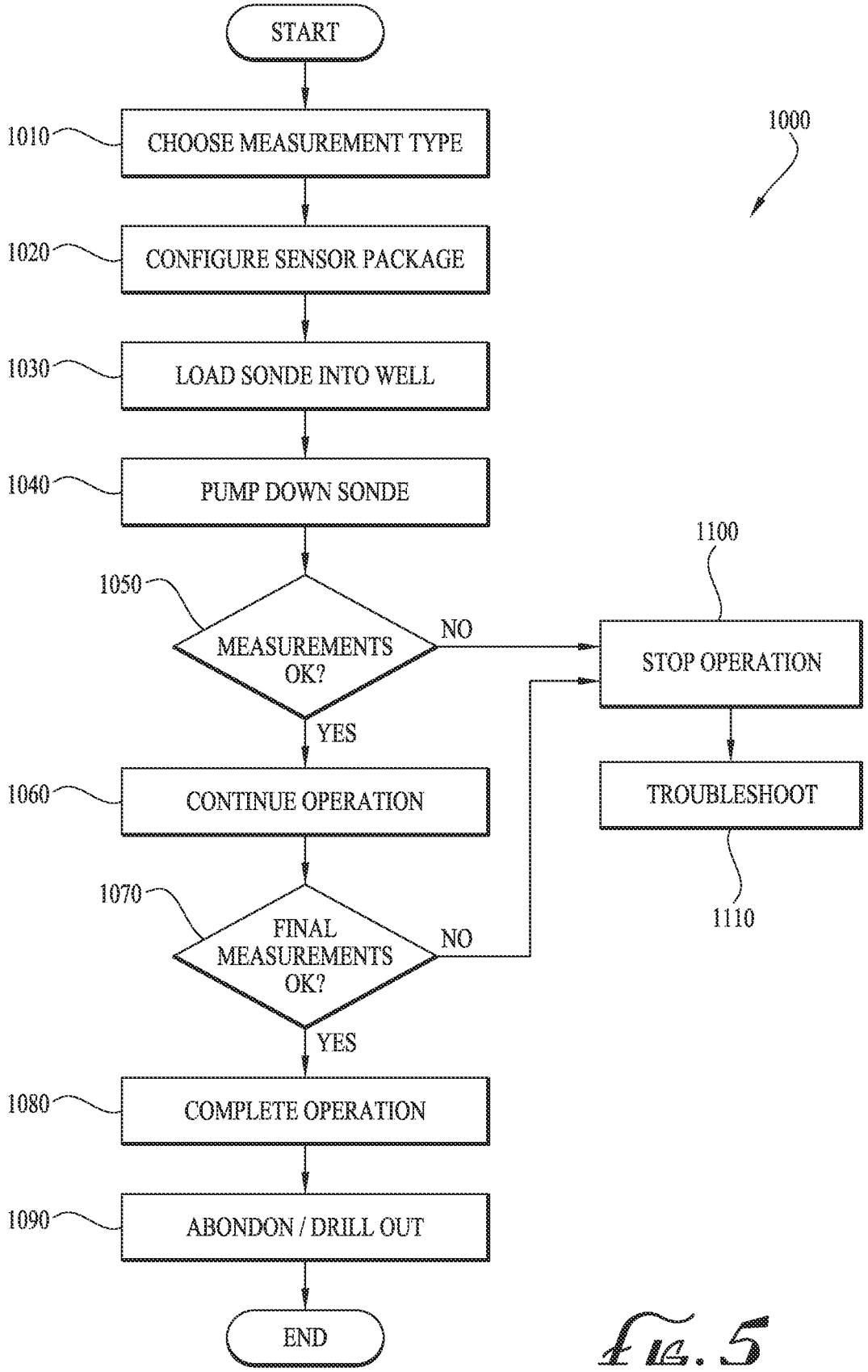
FIG. 5 shows a method of cementing a well with an embodiment of the instrumented dart.

The instrumented dart 46, for example a wiper dart 200 or a foam dart 300, can transmit data, e.g., sensor measurement, to surface by cable or by acoustical signal. The analysis of the data received at surface may indicate one or more problems encountered during a pumping operation. The service personnel can trouble shoot the pumping operation based on the data received. The trouble shooting methods can include stopping the pumping operation. Turning now to FIG. 5, a logical flow diagram depicting an operational method 1000 to the wellbore pumping operation is described. At block 1010, the service personnel can choose a measurement type for the instrumented dart 46. For example, the service personnel may choose a magnetic sensor, e.g., collar tracking sensor, and a pressure sensor for the instrument sub 204A. It is understood, that the personnel could choose any of the sensor types including pressure, temperature, nuclear, magnetic, water cut, a fluid pH value, etc. It is understood that the service personnel could choose any number of sensors and/or sensor types.

At block 1020, the service personnel configure the sensors onto the instrumented dart 46. The configuration of sensors can include choosing a type of dart, for example, a wiper dart 200 or a foam dart 300. The service personnel may choose one or more environmental sensors in one or more instrument subs 204 and one or more external fluid sensors 272 in one or more fluid sub 212. The configuration of sensors can include the programming or configuration of the electronics sub 210. The service personnel may choose a communication method for the instrumented dart 46. For example, the service personnel may configure the instrumented dart 46 with the cable head 214 and communication cable 216 or the communication sub 326. The instrumented dart 46 can include one or more release sub 208.

At block 1030, the service personnel load the sonde, e.g., instrumented dart 46, into the well. The instrumented dart 46 may be loaded into the drop assembly 44 as shown in FIG. 1. The drop assembly 44 retains the instrumented dart 46 in a secured position while fluids used in the pumping operations are pumped by the surface pumps.

At block 1040, the service personnel pump the sonde, e.g., the instrumented dart 46, into the workstring 34. The drop assembly 44 releases the instrumented dart 46 into the workstring 34. for example, during a cementing operation, the instrumented dart 46 is typically released after the lower plug 60, shown in FIG. 3, has been released and at the end of the specified volume of cement slurry. Although, the instrumented dart 46 may be released at the end of the specified volume of cement slurry, it is understood that the instrumented dart may be released anytime the surface pumps are pumping cement, spacer fluid, or a displacement fluid. For example, during a stimulation of the wellbore, the instrument dart 46 can be released after a well stimulation fluid, e.g., acid or proppant, has been pumped into the workstring 34. The fins on the instrumented dart 46 sealingly engage the inner surface of the workstring 34 as the volume of fluid forces the instrumented dart 46 downwards into the workstring 34.

At block 1050, the service personnel monitor the data transmitted from the instrumented dart 46. The data can be transmitted through the communication cable 216 or transmitted through a column of fluid via acoustic signals transmitted by the communication sub 326. A surface system 58 can receive communication signals via signal cable 56 coupled to the wellhead, drop assembly 44, or workstring 34. The surface system 58 can monitor the data and compare the data to an expected data model. If the surface system 58 determines that the data is within a predetermined range of agreement with the data model, the method steps to block 1060.

At block 1060, if the surface system 58 determines that the data is within a predetermined range of agreement with the data model, the surface system notifies the service personnel that the data is within an acceptable range with the data model. The surface system periodically steps back to block 1050 until the pumping operations reach the final stage.

At block 1100, if the surface system 58 determines that the data is not within a predetermined range of agreement with the data model, the surface system notifies the service personnel that an error has occurred. The surface system 58 may notify the service personnel the data received and the deviation from the data model. The service personnel may stop pumping operation and move to step 1110 to trouble shoot.

At step 1110, the service personnel may troubleshoot the error received from the surface system 58. The troubleshooting steps may include manipulating the workstring 34, for example, raising and lowering the workstring 34. The troubleshooting steps may include servicing the surface pumps, for example, repairing or replacing a leaking surface pump. The troubleshooting steps may include changing the pumping speed of the surface pumps, for example, slowing or speeding up the pump rate of the surface pumps. The troubleshooting may include adding a chemical to the fluids pumped from surface to modify the fluid properties down in the wellbore. After the troubleshooting steps are taken, the method may step back to block 1050.

At step 1070, the surface system 58 may perform a final analysis of the data received from the instrument dart 46. if the surface system 58 determines that the data is not within a predetermined range of agreement with the data model, the surface system notifies the service personnel of the deviation and steps to block 1100.

At step 1080, the surface system 58 may notify service personnel that the pumping operation has been completed. The surface system 58 may produce a report comparing the data to the data model.

At step 1090, the service personnel end the pumping operation. In an embodiment, the service personnel may leave or abandon the instrumented dart 46 at the bottom of the wellbore. In an embodiment, the service personnel may initiate the release sub 208 and retrieve the upper section 278. In an embodiment, the instrumented dart 46 can be drilled or milled up by service personnel. In an embodiment, the lower section 276 of the instrumented dart 46 can be drilled or milled up by service personnel.

ADDITIONAL DISCLOSURE

The following is provided as additional disclosure for combinations of features and aspects of the present invention.

A first embodiment, which is an instrumented wiper dart configurable at a wellsite comprising an instrument sub 204, an electronics sub 210, and a communication system 288, coupled together to form a wiper assembly 292, and a sealing member 290 releasably coupled to the wiper assembly 292, wherein the sealing member 290 is cylindrical shape and configured to sealingly engage an inner surface of a workstring 34, wherein the instrument sub 204 is releasably coupled to the wiper assembly 292 and includes at least one environmental sensor 228 to measure a property of a wellbore environment, wherein the electronics sub 210 is releasably coupled to the wiper assembly 292, configured to receive one or more data sets from the instrument sub 204, and relay the one or more data sets to the communication system 288, wherein the one or more data sets comprise periodic wellbore data, and wherein the communication system 288 is configured to transmit the one or more data sets to the surface.

A second embodiment, which is the instrumented wiper dart of the first embodiment, wherein the sealing member 290 comprises i) a dart jacket 242 with a plurality of fins 246, ii) a foam body 316, or iii) combinations thereof.

A third embodiment, which is the instrumented wiper dart of the first or the second embodiment, wherein the instrument sub 204 comprises i) an internal sensor, ii) an external sensor, iii) a fluid property sensor, or iv) combinations thereof.

A fourth embodiment, which is the instrumented wiper dart of any of the first through the third embodiments, wherein the environmental sensor 228 is selected from a group consisting of a magnetic sensor, a pressure sensor, a temperature sensor, a motion sensor, an acoustic sensor, a pH value sensor, a water ratio sensor, a nuclear sensor, and combinations thereof.

A fifth embodiment, which is the instrumented wiper dart of any of the first through the fourth embodiments, wherein the communication system 288 comprises i) a cable head 214 and a communication cable 216, ii) an acoustic signal generator 332, or combinations thereof.

A sixth embodiment, which is the instrumented wiper dart of any of the first through the fifth embodiments, wherein the communication system 288 transmits data via communication cable 216.

A seventh embodiment, which is the instrumented wiper dart of any of the first through the sixth embodiments, further comprising a plug nose 202 releasably coupled to the downhole end of the wiper assembly 292 and configured to release a cementing plug 64, 60 in response to sealingly engaging a release sleeve 72, 100.

An eighth embodiment, which is the instrumented wiper dart of any of the first through the seventh embodiments, further comprising a release sub 208 releasably coupled to the wiper assembly 292 at a separation point 258, and wherein the release sub 208 is configured to separate the wiper assembly 292 into an upper section 278 and a lower section 276 in response to activation of the separation point 258.

A ninth embodiment, which is the instrumented wiper dart of the eighth embodiment, wherein the separation point 258 of the release sub 208 comprises one of i) a reduced cross-sectional area, ii) a shear device, iii) a pyrotechnic fastener, iv) a spring loaded mechanism, or v) a spring loaded mechanism with a fluid damper timer.

A tenth embodiment, which is a method of configuring an instrumented dart, comprising selecting one or more downhole environmental properties to measure, configuring one or more environmental sensors 228 in an instrument sub 204 to measure the one or more downhole environmental properties, selecting a communication system 288, and assembling a wiper assembly 292, wherein the wiper assembly 292 comprises the instrument sub 204, an electronics sub 210, and the communication system 288.

An eleventh embodiment, which is the method of the tenth embodiment, further comprising selecting a sealing member 290, wherein the sealing member 290 is releasably coupled to the wiper assembly 292, and wherein the sealing member 290 is i) a dart jacket 242 with a plurality of fins 246, ii) a foam body 316, or iii) combinations thereof.

A twelfth embodiment, which is the method of the tenth or the eleventh embodiment, further comprising configuring the electronics sub 210 to measure one or more data sets via the instrument sub 204 and transmit the one or more data sets via the communication system 288.

A thirteenth embodiment, which is the method of the twelfth embodiment, wherein the electronics sub 210 is i) configured prior to assembling the wiper assembly 292, ii) configured while assembling the wiper assembly 292, or iii) configured after assembling the wiper assembly 292.

A fourteenth embodiment, which is the method of any of the tenth through the thirteenth embodiments, wherein the one or more environmental sensors 228 of the instrument sub 204 comprise i) an internal sensor, ii) an external sensor, iii) a fluid property sensor, or iv) combinations thereof.

A fifteenth embodiment, which is the method of any of the tenth through the fourteenth embodiments, wherein the communication system 288 comprises i) a cable head 214 and a communication cable 216, ii) an acoustic signal generator 332, or iii) combinations thereof.

A sixteenth embodiment, which is the method of any of the tenth through the fifteenth embodiments, wherein the one or more environmental sensors 228 are selected from a group consisting of a magnetic sensor, a pressure sensor, a temperature sensor, a motion sensor, an acoustic sensor, a pH value sensor, a water ratio sensor, a nuclear sensor, and combinations thereof.

A seventeenth embodiment, which is the method of any of the tenth through the sixteenth embodiments, further comprising transporting the wiper assembly 292 to a wellsite i) in an unassembled state, ii) in a partially assembled state, or iii) in a fully assembled state.

An eighteenth embodiment, which is a method of monitoring a pumping operation, comprising selecting one or more downhole environmental properties to measure, configuring one or more environmental sensors 228 in an instrument sub 204 to measure the downhole environmental properties, selecting a communication system 288, transporting the instrument sub 204, the communication system 288, and an electronics sub 210 to a well site, assembling a wiper assembly 292, wherein the wiper assembly 292 comprises the instrument sub 204, the electronics sub 210, and the communication system 288, moving the wiper assembly 292 down a workstring 34 via a pumping operation, receiving the one or more data sets via the communication system 288, comparing the received data sets to a modeled data set, and troubleshooting the pumping operation in response to the one or more received data sets exceeding a range of the modeled data set.

A nineteenth embodiment, which is the method of the eighteenth embodiment, further comprising selecting a sealing member 290, wherein the sealing member 290 is releasably coupled to the wiper assembly 292, and wherein the sealing member 290 is i) a dart jacket 242 with a plurality of fins 246, ii) a foam body 316, or iii) combinations thereof.

A twentieth embodiment, which is the method of the eighteenth or the nineteenth embodiment, further comprising configuring the electronics sub 210 to measure one or more data sets via the one or more instrument subs 204 and relay the one or more data sets via the communication system 288.

A twenty-first embodiment, which is the method of any of the eighteenth through the twentieth embodiments, further comprising releasing a cementing plug 64 in response to sealingly engaging a release sleeve 72, 100, coupled to the cementing plug 64, with a plug nose 202 coupled to the downhole end of the wiper assembly 292.

A twenty-second embodiment, which is the method of any of the eighteenth through the twenty-first embodiments, further comprising pumping cement through the workstring 34 via the pumping operation, and wherein the wiper assembly 292 is released into the workstring 34 in front of the cement or behind the cement.

A twenty-third embodiment, which is the method of any of the eighteenth through the twenty-second embodiments, further comprising abandoning the wiper assembly 292 at an end of the pumping operation.

A twenty-fourth embodiment, which is the method of any of the eighteenth through the twenty-third embodiments, wherein the instrument sub 204 comprises i) an internal sensor, ii) an external sensor, iii) a fluid property sensor, or iv) combinations thereof.

A twenty-fifth embodiment, which is the method of any of the eighteenth through the twenty-fourth embodiments, wherein the one or more environmental sensors 228 are selected from a group consisting of a magnetic sensor, a pressure sensor, a temperature sensor, a motion sensor, an acoustic sensor, a pH value sensor, a water ratio sensor, a nuclear sensor, and combinations thereof.

A twenty-sixth embodiment, which is the method of any of the eighteenth through the twenty-fifth embodiments, wherein the wiper assembly 292 is transported to the wellsite i) in an unassembled state, ii) in a partially assembled state, or iii) in a fully assembled state.

While embodiments of the invention have been shown and described, modifications thereof can be made by one skilled in the art without departing from the spirit and teachings of the invention. The embodiments described herein are exemplary only, and are not intended to be limiting. Many variations and modifications of the invention disclosed herein are possible and are within the scope of the invention. Where numerical ranges or limitations are expressly stated, such express ranges or limitations should be understood to include iterative ranges or limitations of like magnitude falling within the expressly stated ranges or limitations (e.g., from about 1 to about 10 includes, 2, 3, 4, etc.; greater than 0.10 includes 0.11, 0.12, 0.13, etc.). For example, whenever a numerical range with a lower limit, R1, and an upper limit, Ru, is disclosed, any number falling within the range is specifically disclosed. In particular, the following numbers within the range are specifically disclosed: R=R1+k*(Ru-R1), wherein k is a variable ranging from 1 percent to 100 percent with a 1 percent increment, i.e., k is 1 percent, 2 percent, 3 percent, 4 percent, 5 percent, . . . 50 percent, 51 percent, 52 percent, . . . , 95 percent, 96 percent, 97 percent, 98 percent, 99 percent, or 100 percent. Moreover, any numerical range defined by two R numbers as defined in the above is also specifically disclosed. Use of the term "optionally" with respect to any element of a claim is intended to mean that the subject element is required, or alternatively, is not required. Both alternatives are intended to be within the scope of the claim. Use of broader terms such as comprises, includes, having, etc. should be understood to provide support for narrower terms such as consisting of, consisting essentially of, comprised substantially of, etc.

Accordingly, the scope of protection is not limited by the description set out above but is only limited by the claims which follow, that scope including all equivalents of the subject matter of the claims. Each and every claim is incorporated into the specification as an embodiment of the present invention. Thus, the claims are a further description and are an addition to the embodiments of the present invention. The discussion of a reference in the Detailed Description of the Embodiments is not an admission that it is prior art to the present invention, especially any reference that may have a publication date after the priority date of this application. The disclosures of all patents, patent applications, and publications cited herein are hereby incorporated by reference, to the extent that they provide exemplary, procedural or other details supplementary to those set forth herein.

What is claimed is:

1. An instrumented wiper dart configurable at a wellsite having a wellbore penetrating a subterranean formation, comprising:

a combined instrument sub comprising a processor and one or more environmental sensors to measure a property of a wellbore environment;

a communication system selectable between i) wired or ii) wireless communication;

and a sealing member selectable between i) rubber or ii) foam and comprising a cylindrical shape configured to sealingly engage an inner surface of a workstring;

wherein the combined instrument sub is configurable by selection of the one or more environmental sensors;

wherein the combined instrument sub is configurable at the wellsite by programming the combined instrument sub to receive one or more datasets from the one or more environmental sensors and to relay the one or more data sets to the communication system, wherein the one or more data sets comprise periodic wellbore data, and wherein the communication system is configured to transmit the one or more data sets to the surface: and wherein the combined instrument sub, the sealing member, and the communication system are releasably coupled together to form the instrumented wiper dart, and wherein the instrumented wiper dart does not include a release mechanism configured for retrieval of the combined instrument sub comprising one or more environmental sensors from the wellbore.

2. The instrumented wiper dart of claim 1, wherein the sealing member comprises i) a jacket with a plurality of fins, ii) a foam body, or iii) combinations thereof.

3. The instrumented wiper dart of claim 1, wherein the combined instrument sub comprises i) an internal sensor, ii) an external sensor, iii) a fluid property sensor, or iv) combinations thereof.

4. The instrumented wiper dart of claim 1, wherein the environmental sensor is selected from a group consisting of a magnetic sensor, a pressure sensor, a temperature sensor, a motion sensor, an acoustic sensor, a pH value sensor, a water ratio sensor, a nuclear sensor, and combinations thereof.

5. The instrumented wiper dart of claim 1, wherein the communication system comprises i) a cable head and a communication cable, ii) an acoustic signal generator, or combinations thereof.

6. The instrumented wiper dart of claim 1, wherein the communication system transmits data via communication cable.

7. The instrumented wiper dart of claim 1, further comprising a plug nose releasably coupled to a downhole end of the wiper assembly and configured to release a cementing plug in response to sealingly engaging a release sleeve.

8. The instrumented wiper dart of claim 1, further comprising:

a release sub releasably coupled to the wiper assembly at a separation point;

wherein the release sub is configured to separate the wiper assembly into an upper section and a lower section in response to activation of the separation point; and wherein the release sub is configurable by selecting the separation point.

9. The instrumented wiper dart of claim 8, wherein the separation point of the release sub comprises one of i) a reduced cross-sectional area, ii) a shear device, iii) a pyrotechnic fastener, iv) a spring loaded mechanism, or v) a spring loaded mechanism with a fluid damper timer.

10. A method of configuring an instrumented dart at a wellsite having a wellbore penetrating a subterranean formation, comprising:

transporting a dart assembly to the wellsite i) in an unassembled state or ii) in a partially assembled state;

selecting one or more downhole environmental properties to measure;

configuring one or more environmental sensors in a combined instrument sub to measure the one or more downhole environmental properties, and wherein configuring the one or more environmental sensors comprises programming a processor to gather datasets of the one or more downhole environmental properties selected via the one or more environmental sensors;

selecting a communication system; and assembling the dart assembly to a fully assembled state, wherein the dart assembly comprises the combined instrument sub and the communication system;

placing the dart assembly into the wellbore during a pumping operation; and at the end of the pumping operation, abandoning the wiper assembly comprising the instrument sub in the wellbore or drilling out the wiper assembly comprising the instrument sub from the wellbore.

11. The method of claim 10, further comprising:

selecting a sealing member;

wherein the sealing member is releasably coupled to the dart assembly; and wherein the sealing member is i) a dart jacket with a plurality of fins, ii) a foam body, or iii) combinations thereof.

12. The method of claim 10, further comprising:

configuring the combined instrument sub to transmit the one or more data sets via the communication system, and wherein configuring the combined instrument sub comprises programming the combined instrument sub to transmit the one or more data sets via the communication system.

13. The method of claim 12, wherein:

the combined instrument sub is i) configured prior to assembling the dart assembly, ii) configured while assembling the dart assembly, or iii) configured after assembling the dart assembly.

14. A method of monitoring a pumping operation comprising:

selecting one or more downhole environmental properties to measure;

selecting i) a wired or ii) a wireless communication system;

transporting the communication system and a combined instrument sub to a wellsite;

configuring, at the wellsite, one or more environmental sensors in the combined instrument sub to measure the downhole environmental properties, wherein configuring one or more environmental sensors comprises programming the combined instrument sub to measure the selected one or more downhole environmental properties via the one or more environmental sensors;

assembling a wiper assembly, wherein the wiper assembly comprises the combined instrument sub and the communication system;

moving the wiper assembly down a workstring disposed in a wellbore via a pumping operation;

receiving one or more data sets at surface via the communication system;

comparing the received data sets to a modeled data set;

troubleshooting the pumping operation in response to the one or more received data sets exceeding a range of the modeled data set; and at the end of the pumping operation, abandoning the wiper assembly comprising the instrument sub in the wellbore or drilling out the wiper assembly comprising the instrument sub from the wellbore.

15. The method of claim 14, further comprising:

configuring a sealing member at the wellsite;

wherein configuring comprises selecting a sealing member;

wherein the sealing member is releasably coupled to the wiper assembly; and wherein the sealing member is i) a dart jacket with a plurality of fins, ii) a foam body, or iii) combinations thereof.

16. The method of claim 14, further comprising:

configuring the combined instrument sub to relay the one or more data sets via the communication system, and wherein configuring the combined instrument sub comprises programming the combined instrument sub.

17. The method of claim 14, further comprising:

releasing a cementing plug in response to sealingly engaging a release sleeve coupled to the cementing plug, with a plug nose coupled to a downhole end of the wiper assembly.

18. The method of claim 14, further comprising:

pumping cement through the workstring via the pumping operation; and wherein the wiper assembly is released into the workstring 34 in front of the cement or behind the cement.

19. The method of claim 14, further comprising: transporting the wiper assembly to a wellsite i) in an unassembled state or ii) in a partially assembled state.

20. The method of claim 14, wherein the wiper assembly does not include a release mechanism configured for retrieval of the combined instrument sub comprising one or more environmental sensors from the wellbore.

* * * * *